US010794042B2

(12) United States Patent
Rivard

(10) Patent No.: US 10,794,042 B2
(45) Date of Patent: Oct. 6, 2020

(54) MOTOR VEHICLE FOR PRODUCING TRENCHES IN THE GROUND

(71) Applicant: GROUPE MARAIS, Durtal (FR)

(72) Inventor: Daniel Rivard, Paris (FR)

(73) Assignee: GROUPE MARAIS, Durtal (FR)

( * ) Notice: Subject to any disclaimer, the term of this patent is extended or adjusted under 35 U.S.C. 154(b) by 38 days.

(21) Appl. No.: 16/287,925

(22) Filed: Feb. 27, 2019

(65) Prior Publication Data

US 2019/0264421 A1 Aug. 29, 2019

(30) Foreign Application Priority Data

Feb. 28, 2018 (FR) ..... 18 51783

(51) Int. Cl.
*G06F 7/70* (2006.01)
*E02F 9/20* (2006.01)
(Continued)

(52) U.S. Cl.
CPC ..... *E02F 9/205* (2013.01); *E02F 3/181* (2013.01); *E02F 3/183* (2013.01); *E02F 3/26* (2013.01);
(Continued)

(58) Field of Classification Search
CPC . E02F 9/205; E02F 3/9212; E02F 5/14; E02F 5/08; E02F 3/26; E02F 3/183; E02F 3/181; G06F 7/70
(Continued)

(56) References Cited

U.S. PATENT DOCUMENTS

2002/0139014 A1* 10/2002 Rivard ..... E02F 3/9212 37/355
2012/0102657 A1* 5/2012 Wildeman ..... A47C 31/001 5/698
(Continued)

FOREIGN PATENT DOCUMENTS

| | | | |
|---|---|---|---|
| EP | 2 698 304 | A1 | 2/2014 |
| FR | 2 822 862 | A1 | 10/2002 |
| WO | 2012/102657 | A1 | 8/2012 |

OTHER PUBLICATIONS

Bartelmei, S., "Hydrostatische Antriebe für eine Schlitzfräsmaschine: Projektierung und Realisierung," O & P—Oelhydraulik und Pneumatik: Zeitschrift für Fluidtechnik, Aktorik, Steuerelektronik und Sensorik, Vereinigte Fachverlage GmbH 46(3):159-164, Mar. 2002.
(Continued)

*Primary Examiner* — Shardul D Patel
(74) *Attorney, Agent, or Firm* — Christensen O'Connor Johnson Kindness PLLC

(57) ABSTRACT

A vehicle for producing trenches in the ground is provided. The vehicle generally includes a chassis having a motor unit, a controllable digging device mounted on the chassis to dig a trench, and a controllable suctioning and collecting device configured to suction and collect rubble produced during the digging of the trench. The vehicle may include a driver station for the movement on the ground of the vehicle during a transfer phase, and a portable and remote control unit configured to enable an operator to remotely control the digging device, the suctioning and collecting device, and the advancing of the vehicle during digging in the course of a working phase.

14 Claims, 4 Drawing Sheets

(51) Int. Cl.

| | |
|---|---|
| ***E02F 3/18*** | (2006.01) |
| ***E02F 3/26*** | (2006.01) |
| ***E02F 5/08*** | (2006.01) |
| ***E02F 5/14*** | (2006.01) |
| ***E02F 3/92*** | (2006.01) |

(52) U.S. Cl.
CPC ..... *E02F 3/9212* (2013.01); *E02F 5/08* (2013.01); *E02F 5/14* (2013.01)

(58) Field of Classification Search
USPC ..... 701/50; 405/129, 264; 37/355
See application file for complete search history.

(56) References Cited

U.S. PATENT DOCUMENTS

| | | | | |
|---|---|---|---|---|
| 2015/0217803 | A1* | 8/2015 | Sudale | E02F 9/2087 701/41 |
| 2016/0340867 | A1* | 11/2016 | Matsuzaki | B60W 50/10 |
| 2017/0138016 | A1* | 5/2017 | Wei | E02F 9/205 |

OTHER PUBLICATIONS

French Search Report dated Oct. 23, 2018, issued in French Application No. 1851783, filed Feb. 28, 2018, 3 pages.

* cited by examiner

MOTOR VEHICLE FOR PRODUCING TRENCHES IN THE GROUND

BACKGROUND

The production of trenches in the ground is intended for placing elongate objects such as, for example, optical and/or electrical cables, pipelines and/or fluid conduits, etc.

Generally, producing a trench in the ground, which can be the pavement or roadside of a road or similar, is made by a digging device with a wheel trencher carried by a specific motor vehicle. Owing to the rotation of the wheel trencher and the advancement of the vehicle, a trench is obtained in the ground at the desired depth.

Document FR-2 822 862 generally discloses a motorized vehicle for producing trenches in the ground, which comprises on a chassis, in addition to a device for digging trenches with a wheel trencher, a device for suctioning and collecting rubble produced during the digging of the trench. Thus, the same motorized vehicle ensures the functions of digging the trench and suctioning and collecting rubble, which makes it possible, under working conditions, to considerably reduce the inconvenience caused during the execution of works on the road network and to also decrease the logistics engaged and the production costs. Also, under transport conditions, the vehicle can easily and legally move thanks to the fact that the structure carrying the digging device is fixed on the chassis. Thus, the vehicle can be used on the secondary road network. In addition, the autonomous character of the vehicle gives it a great flexibility of use, making it possible for it to make trenches in different places during the same day without resorting to excessive logistics.

Although this motorized vehicle thus has numerous advantages, it requires at least two operators for the use thereof in the working phase, namely an operator in the driver station who drives the vehicle and at least one operator on the ground who controls different devices and in particular the digging device. In addition, each of these operators carries out their own operations and has no overall vision of the vehicle and of the site.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

According to one or more aspects of the present disclosure, a motor vehicle for producing trenches in the ground comprises, in addition, at least one portable and remote control unit, and said control unit is configured to make it possible for an operator to control, remotely, at least the digging device and the suctioning and collecting device during digging in the course of a working phase, as well as the advancing of the vehicle at least during the working phase.

Thus, during the working phase, e.g., during the digging of a trench, a single operator can control, using the portable control unit, all the operations and functions necessary for the digging of the trench, namely digging, collecting rubble, and the advancing of the vehicle.

Consequently, all the work can be carried out by a single operator, instead of two or more, which makes it possible to reduce the production cost of the site.

In addition, as the control unit is portable and remote (i.e. it is not mechanically connected to the vehicle), the operator can be moved to the proximity or even around the vehicle, which makes it possible for them to have an extended vision of the site and facilitates their work.

Furthermore, thanks to the driver station, the vehicle can be quickly moved (in a phase called transfer phase) from one trenching zone to another on a site comprising discontinuous trenching zones. As a result of the reduced template of the vehicle, such as specified below, the vehicle can be easily transported and quickly brought by a carrier (e.g., a lorry) to a site.

In one embodiment, the suctioning and collecting device comprises a tipping collection tank, of which the tipping is controllable, and the control unit is configured to make it possible for an operator to also control, remotely, the tipping of said collection tank. Advantageously, the collection tank is configured to be able to be tipped laterally towards either of the two sides (right or left), which makes it possible to adapt the emptying of the collection tank to the environment of the vehicle.

Furthermore, advantageously, to facilitate the emptying, the motor vehicle comprises removable arms (telescopic, retractable, etc.) for supporting a "big-bag" type transport bag, said arms being positioned on the chassis such that the transport bag that they carry can directly receive the rubble discharged from the collection tank, during a tipping of said collection tank.

Moreover, in a further embodiment, the motor unit comprises at least four wheels which are guide wheels. Advantageously, the control unit is configured to make it possible for an operator to control, remotely, the directions of these guide wheels. In some embodiments, the wheels of the motor unit are configured to make it possible for a movement in a crab mode (in transfer phase and/or in working phase). This configuration makes it possible to facilitate the maneuverability of the vehicle, for example with the possibility of sharp turns or the easy placing of the vehicle at the edge of obstacles (such as pavements, for example). Thus, the vehicle is particularly capable of easily reaching cramped places.

Moreover, in a specific embodiment, the motor unit comprises two front wheels capable of being driven and two rear wheels capable of being driven. Advantageously, the motor unit is configured such that the two front wheels are driven during the transfer phase and such that the two rear wheels are driven during the working phase.

Furthermore, in some embodiments, the control unit comprises a portable casing equipped with control members and with a radio emission unit comprising an antenna, the emission unit being configured to emit radio-electric waves of command orders generated by the operator by way of control members.

In addition, in other embodiments, the vehicle comprises at least one embedded auxiliary control unit, this auxiliary control unit comprising at least one radio reception unit configured to receive command orders emitted via radio-electric waves by the control unit, a central unit to process these command orders received and connection means to transmit commands to elements of the vehicle according to these command orders received.

Moreover, to ensure an optimal distribution of loads on said vehicle, said suctioning and collecting device is arranged in the central part of said chassis and said digging device is arranged in the rear part of the chassis.

Furthermore, in one embodiment, the vehicle comprises at least one radar configured to detect an intrusion in at least one detection zone defined at least partially around the vehicle, and at least one alarm to warn the operator in case an intrusion is detected. In this embodiment, the vehicle comprises, also, preferably, a stop unit configured to automatically stop, at least the advancing of the vehicle, if the operator has not carried out a planned action, at the end of a predetermined duration after the detection of an intrusion.

DESCRIPTION OF THE DRAWINGS

The foregoing aspects and many of the attendant advantages of the present disclosure will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, are intended as a description of various embodiments of the present disclosure and are not intended to represent the only embodiments. Each embodiment described in this disclosure is provided merely as an example or illustration and should not be construed as precluding other embodiments. The illustrative examples provided herein are not intended to be exhaustive or to limit the disclosure to the precise forms disclosed.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present disclosure relates to a motor vehicle for producing trenches in the ground. The present disclosure aims to overcome the aforementioned disadvantages of convention trench digging machinery. Embodiments of the present disclosure relate to a motor vehicle for producing trenches in the ground, the vehicle comprising a chassis and a motor unit and, mounted on the chassis, a controllable digging device comprising a trenching tool configured to dig a trench and a controllable suctioning and collecting device and configured to suction and collect rubble produced during the digging of the trench with the trenching tool, said vehicle also comprising a driver station for the movement on the ground of the vehicle during a phase called transfer phase (in particular, during the movement of the vehicle from one trenching zone to another trenching zone on a site).

Figure 1:
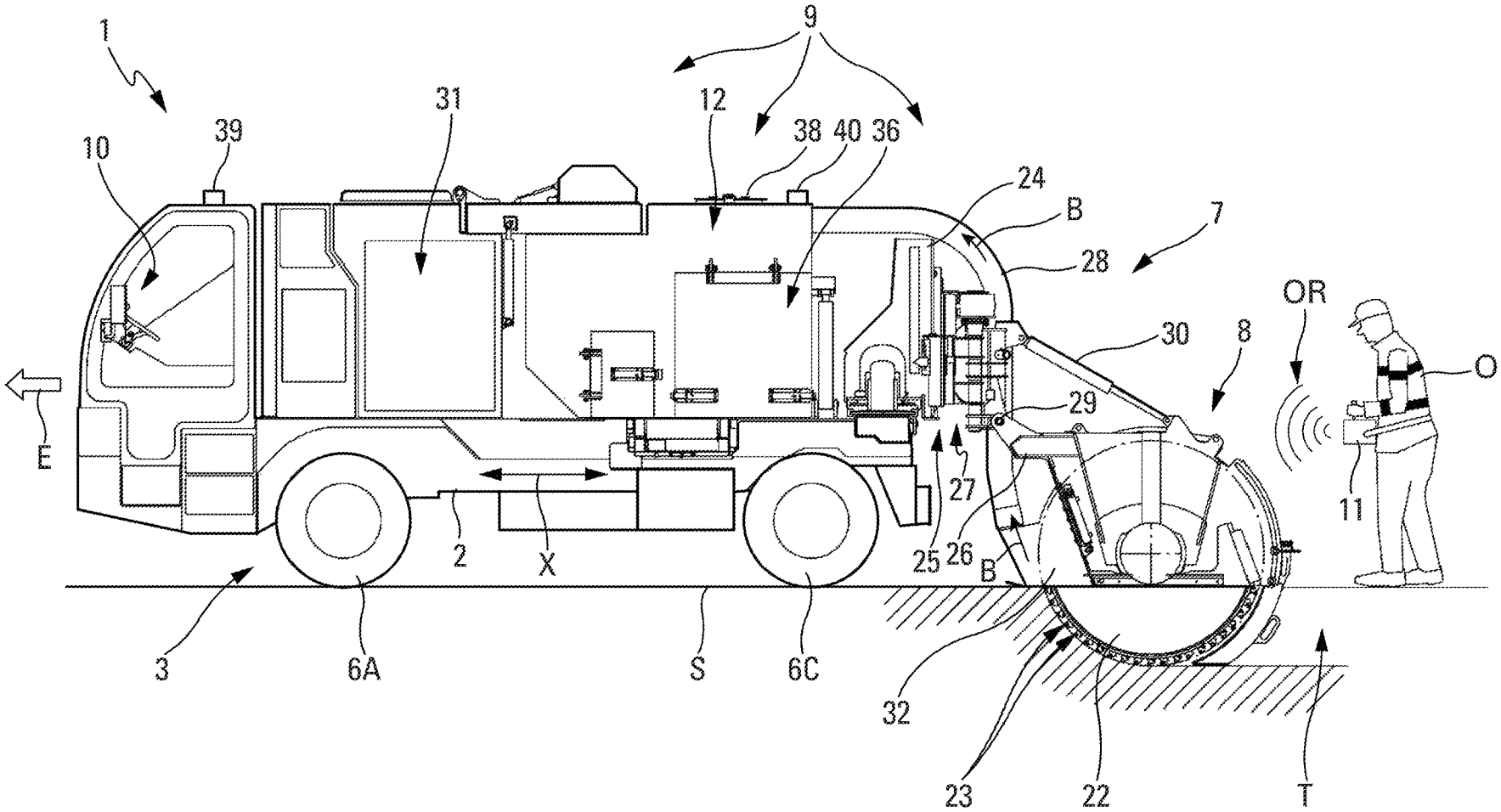
FIG. 1 is elevation top view of one representative embodiment of a motor vehicle in accordance with the present disclosure, showing the motor vehicle during the digging of a trench in the course of a working phase.
Figure 2:
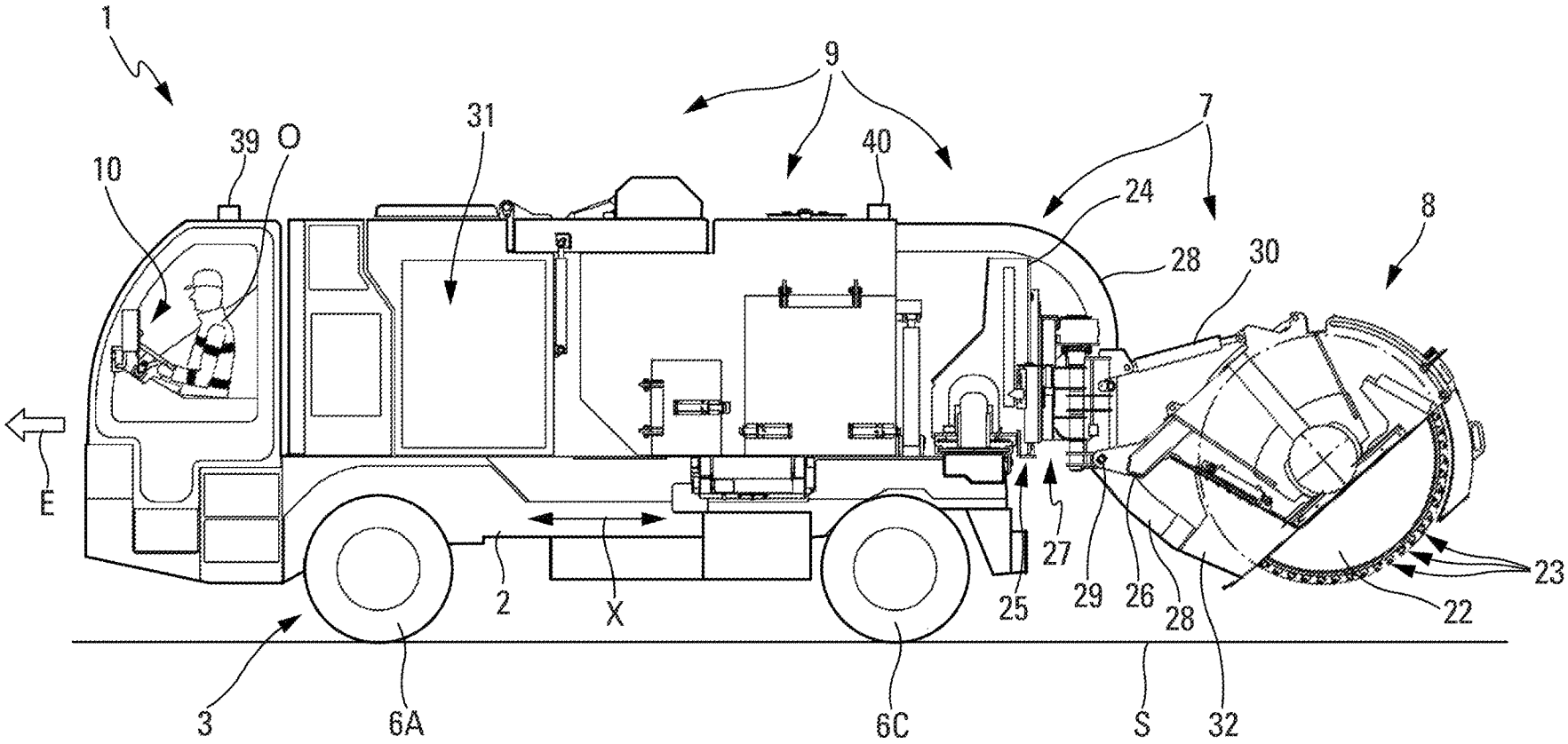
FIG. 2 is a top view of the motor vehicle of FIG. 1, showing the motor vehicle during a transfer phase.

The motor vehicle 1 (hereinafter "vehicle"), represented in FIGS. 1 and 2, is intended to produce trenches in the ground to place elongate objects such as sheaths or cables, for example optical and/or electrical cables.

The vehicle 1 comprises, conventionally, a chassis 2 of longitudinal axis X and a motor unit 3 to generate the movement of the vehicle 1 on the ground, in the direction illustrated by an arrow E in FIGS. 1 and 2 for a movement towards the front.

Figure 4:
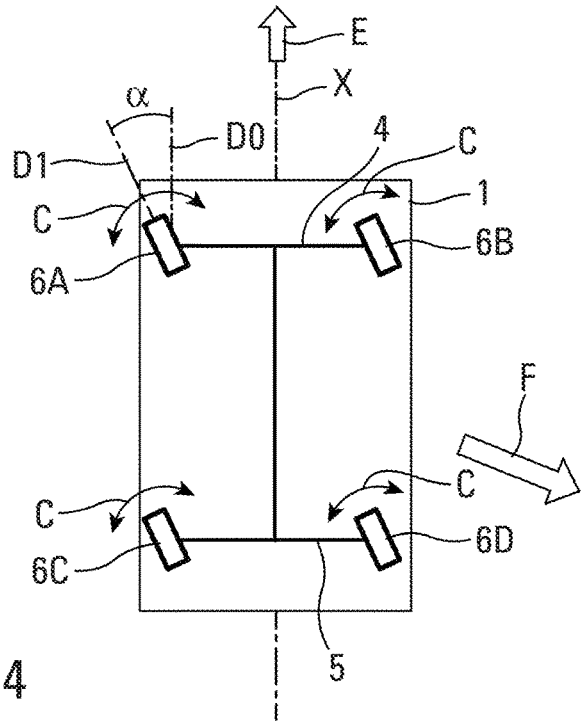
FIG. 4 is a schematic view representing directions of the four guide wheels of the vehicle.

This motor unit 3 is associated with two axles, a front axle 4 and a rear axle 5, each equipped with wheels, namely wheels 6A and 6B on the front axle 4 (FIG. 4), and wheels 6C and 6D on the rear axle 5 (FIG. 4).

In some embodiments, the vehicle 1 also comprises, on the chassis 2, both a digging device 7 provided with a trenching tool 8 to produce a trench T in the ground S (of a road, for example) and a suctioning and collecting device 9 configured to suction and collect the rubble produced during the digging of the trench T with the trenching tool 8.

In other embodiments, the vehicle 1 comprises a conventional driver station 10 (situated, for example, in a cabin) for the movement on the ground of said vehicle 1 during a transfer phase, as specified below. The driver station 10 comprises a dashboard equipped, conventionally, in particular with a steering wheel, buttons, levers, etc.

According to the present disclosure, the vehicle 1 comprises, in addition, for the control thereof, a control unit 11: which is portable, i.e. it can be carried by an operator O (FIG. 1); and which is remote, i.e. it is not mounted and fixed on the vehicle 1.

According to the present disclosure, this control unit 11 is configured to make it possible for the operator O who carries it to remotely control (by remote controls), the digging device 7 and the suctioning and collecting device 9 during the digging in the course of a working phase, as well as the advancing of the vehicle 1 at least during this working phase.

In one embodiment, the suctioning and collecting device 9 comprises a tipping collection tank 12 (or rubble recovery tank), of which the tipping is controllable, as specified below in reference to FIGS. 5A and 5C. The control unit 11 is configured to make it possible for the operator O to also control, remotely (by remote controls), the tipping of said collection tank 12.

Figure 3:
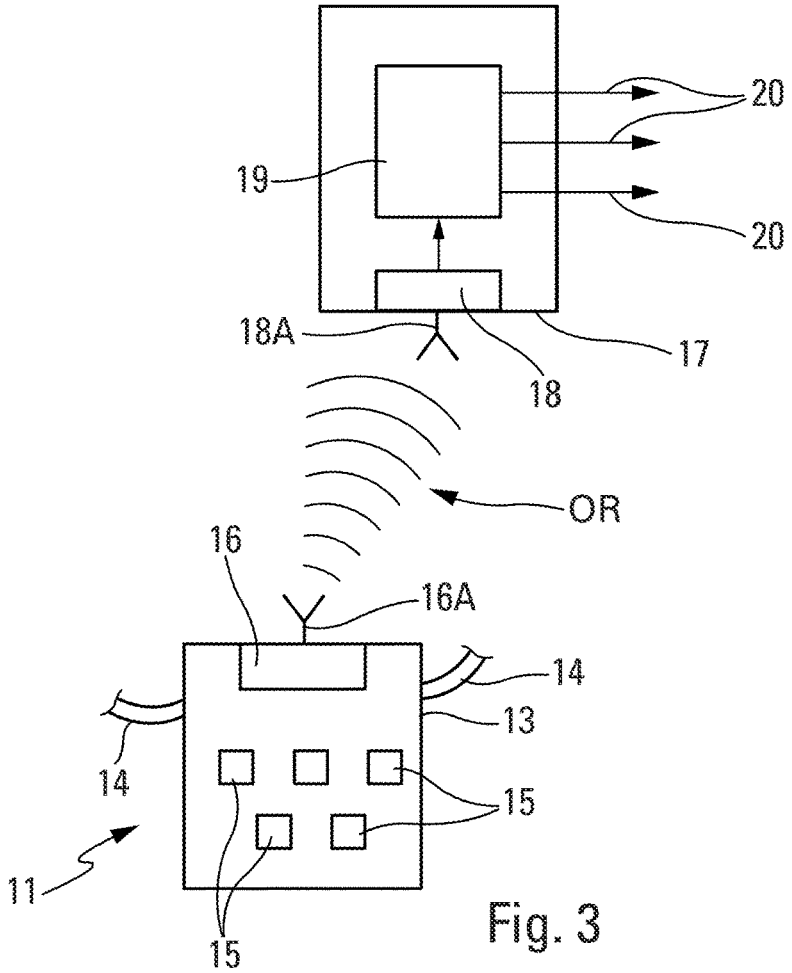
FIG. 3 is a schematic view representing a portable control unit configured to transmit command orders, by radioelectric waves, to an auxiliary control unit embedded on the vehicle, with which the portable control unit cooperates.

As schematically represented in FIG. 3, the control unit 11 comprises a portable casing 13 which can comprise means 14 (belt, straps, etc.) making it possible for the operator to carry it easily. This portable casing 13 is equipped with control members 15 (for example, levers, buttons, a steering wheel, etc.) and a radio emission unit 16 provided with an antenna 16A. The emission unit 16 is configured to emit, by radio-electric waves OR, command orders generated by the operator by way of control members 15.

The vehicle 1 comprises at least one auxiliary control unit 17 which is embedded and installed on the vehicle 1. This auxiliary control unit 17 comprises, as illustrated in FIG. 3, at least one radio reception unit 18 provided with an antenna 18A and configured to receive the command orders emitted by radioelectric waves OR by the control unit 11. The auxiliary control unit 17 also comprises a central unit 19 to process these command orders received and connecting means 20 (cables, wires, etc.) to transmit commands to the elements (digging device 7, suctioning and collecting device 9, motor unit 3, etc.) of the vehicle 1 according to the command orders received, in order to control these elements.

Moreover, in an embodiment, the motor unit 3 comprises four wheels 6A to 6D which are guide wheels, i.e. each of these wheels 6A to 6D can be oriented in both directions, as illustrated by double arrows C in FIG. 4. Each of these wheels 6A to 6D can therefore be oriented (by control) to take a driving direction D1 having a variable angle with respect to a neutral direction D0 (parallel to the longitudinal axis X), as illustrated by an angle $\alpha$ for the wheel 6A in FIG. 4. In this embodiment, the control unit 11 is configured to make it possible for the operator O to control, remotely, the orientations (or directions) of the four drive wheels 6A to 6D during a working phase. The orientations of these drive wheels 6A to 6D can also be controlled from the driver station 10 during a transfer phase.

The four wheels 6A to 6D of the motor unit 3 are thus configured to make it possible, in addition to a usual movement along the longitudinal axis X, a lateral movement, transversal to the longitudinal axis X, as illustrated by an arrow F in FIG. 4, and in particular, a movement in a crab mode, i.e. substantially orthogonal to the longitudinal axis X.

These characteristics (four guide wheels 6A to 6D) make it possible to facilitate the manoeuvrability of the vehicle 1, for example with the possibility of sharp turns (by making it possible in particular, through a simultaneous action on the orientations of four drive wheels 6A to 6D, to reduce the turning radius of the vehicle 1) or the easier use of the vehicle 1 at the edge of obstacles such as pavements, for example. Thus, the vehicle 1 is in particular capable of easily reaching cramped places. In addition, the wheels 6A to 6D are equipped with tires, which make it possible for a non-aggressive movement for the pavement.

Moreover, in a specific embodiment, the two front wheels 6A and 6B are capable of being driven and the two rear wheels 6C and 6D are also capable of being driven. The front wheels and the rear wheels can be driven, simultaneously or separately.

In an embodiment, the motor unit 3 is configured such that the two front wheels 6A and 6B are driven during the transfer phase (see FIG. 2) and such that the two rear wheels 6C and 6D are driven during the working phase (see FIG. 1).

Thus, as a result of the aforementioned characteristics, the following modes, among other modes, are possible: front axle drive in transfer configuration; rear axle drive in working configuration; two wheel drive-mode in transfer and/or working configurations; four wheel drive-mode in transfer and/or working configurations; and crab mode in transfer and/or working configurations.

As represented in FIGS. 1 and 2 (associated with FIG. 4), the digging device 7 is situated in the rear part of the chassis 2, behind the rear axle 5 (wheels 6C and 6D), and the suctioning and collecting device 9 is arranged in the central part of the chassis 2 substantially between the front axle 4 (wheels 6A and 6B) and the rear axle 5, which makes it possible in particular to optimally distribute loads on the chassis 2.

In a specific embodiment, the digging device 7 and the suctioning and collecting device 9 can correspond, at least partially, respectively to the digging device and to the suctioning and collecting device described in abovementioned document FR-2 822 862.

In one embodiment, the trenching tool 8 of the digging device 7 comprises a wheel trencher 22, as represented in FIGS. 1 and 2. Usually, this wheel trencher 22 is equipped on the periphery thereof with cutting members 23 (peaks or teeth). Any other type of wheel trencher like cutting and sawing discs can of course be used according to the desired applications.

In the example illustrated, the wheel trencher 22 is intended to produce narrow trenches (of around 1 to 5 cm) and of low depth (less than 50 cm), in particular for placing cables (optical, electrical, telephone, etc.).

In one example, the wheel trencher 22 is mounted on a rotating mechanism driven in rotation by at least one motor member such as a geared motor. More specifically, the digging device 7 shown in FIGS. 1 and 2 comprises a bracket 24 drawn perpendicularly to the plane of the chassis 2 and mounted sliding on sliders. The digging device 7 can thus be moved on these sliders via a motor member such as an actuator. In addition, along the bracket 24, vertical sliders can be provided inside which a carriage 25 is mounted sliding. Thus, the wheel trencher 22 of the digging device 7 can be moved in a plane perpendicular to the chassis 2 to adjust, in particular, the depth of the trench to be produced. On the carriage 25 of the bracket 24, in the part shown by an arrow 27, is shown a cant correction plate hinged in rotation by an actuator which makes it possible to correct the horizontal plate of the trenching tool 8 (wheel trencher 22) and to ensure a vertical trench without the planarity stresses of the ground. On this cant correction plate is mounted a pivot hinged by a releasable rotating actuator, making it possible for a free function of the pivot movement for the work and a rigid function for the manoeuvres of the rotation of the aboveground trenching tool 8. This pivot also makes it possible to reposition the trenching tool 8 in the gauge of the vehicle 1 and to decrease the rear cantilever, particularly important during the transfer phases. For some small trenching tools 8, the retraction can be of up to 90°.

The wheel trencher 22 is remote from the chassis, cantilevered with respect to the rear of it, in the working position thereof, which makes it possible to bring, between a structure 26 of the wheel trencher 22 and the chassis 2, a flexible suction conduit 28 for suctioning rubble directly exiting the cutting face.

Moreover, the structure 26 is, in a known manner, of a hinged type about an axis 29 parallel to the rotating mechanism (horizontal axis of the wheel) such that, under the action of an actuator 30 connecting the two hinged parts of the structure 26, the wheel trencher 22 can occupy: either a lowered position to progressively dig the ground S and to produce the trench, as represented in FIG. 1; or a raised position, with respect to the ground S, as represented in FIG. 2.

The suctioning and collecting device 9 comprises, in the embodiment example represented: (1) a device 31, for example a turbine, to generate a low pressure, which is arranged on the chassis 2 towards the front; (2) the collection tank 12 (or recovery tank) to recover the rubble produced, which is also arranged on said chassis 2; (3) a casing 32 connected to the structure 26 of the wheel trencher 22 and surrounding the outer part thereof situated outside of the trench, said casing 32 coming into contact with the ground to form, with said outer part of the wheel, an inner space; and (4) the suction conduit 28 connecting the device 31 to the casing 32 to suction the rubble generated, in the direction of the collection tank 12, in the direction illustrated by the arrows B in FIG. 1, owing to the reduction of pressure of said inner space, via said device 31.

Structurally, the casing 32 has a semi-circular plane shape of which the cross-section has an inverted U shape, inside which is arranged the corresponding part of the wheel. The casing 32 is ended with an expanded base or a base constituted by an outer edge which comes into contact with the surface of the ground S, as represented in FIG. 1. Thus, a relative narrow space is defined between the casing 32 and the corresponding part surrounded by the wheel trencher 22.

The casing 32 is equipped with a suction nozzle, easily removable with respect to the casing 32. The suction nozzle is designed to fix the suction conduit 28 in the upper part and is equipped with openings in the lower part, ensuring an air passage which improves the suction performances of the excavated materials.

Figure 5C:
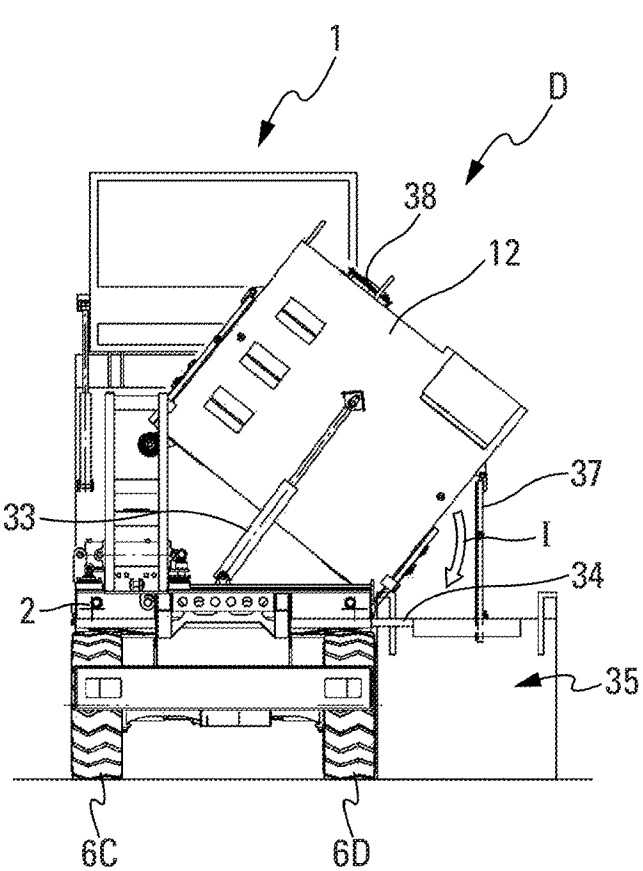
FIGS. 5A, 5B and 5C are rear views of the motor vehicle of FIG. 1, illustrating different positions of the tipping collection tank, respectively, during a discharge phase towards the left, during a working phase, and during a discharge phase towards the right.
Figure 5B:
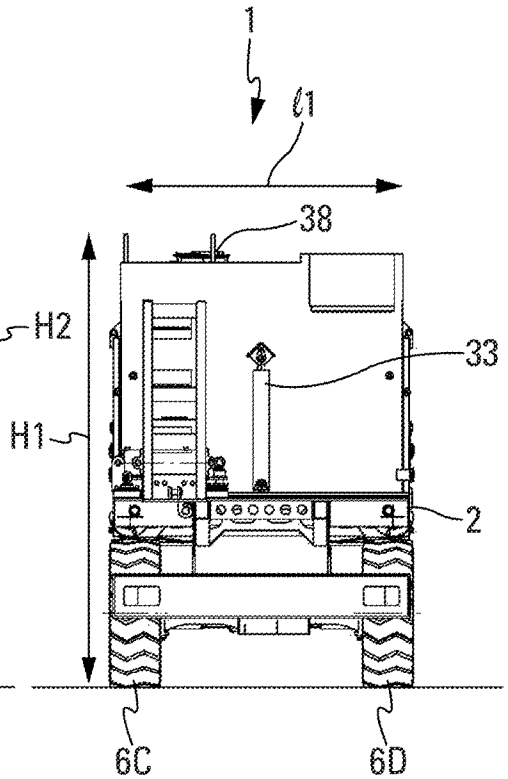
Figure 5A:
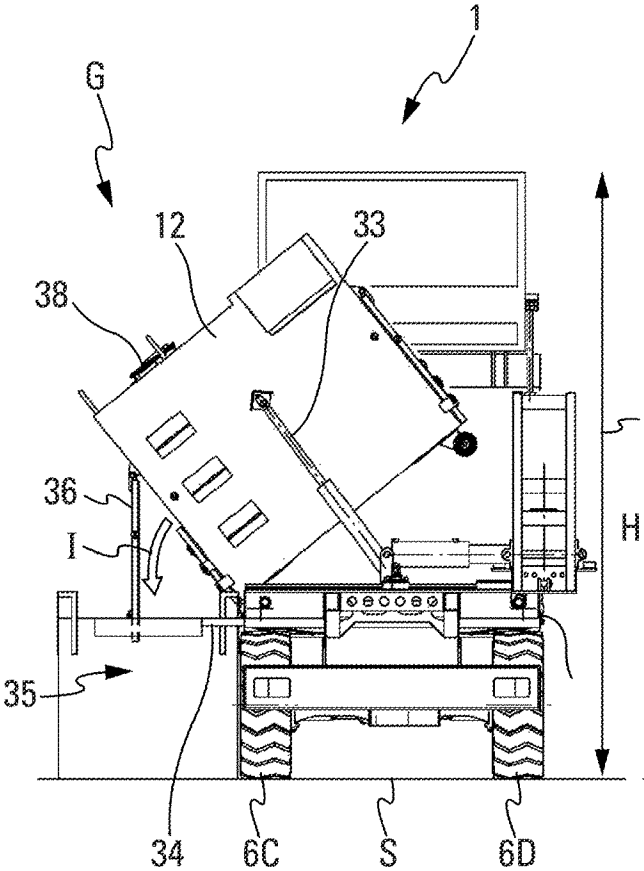

The collection tank 12 is mounted hinged on the chassis 2 so as to be able to laterally tipped, via the actuators of which the actuator 33 shown in FIGS. 5A to 5C. A rotating structure is provided, preferably, making it possible to both carry and to hinge the collection tank.

In one embodiment, the collection tank 12 is configured to be able to be laterally tipped, by choice, towards either of the two sides (left or right), which makes it possible to adapt the emptying of the collection tank 12 to the environment of the vehicle 1.

FIGS. 5A, 5B and 5C are rear views of the vehicle 1, illustrating different positions of the tipping collection tank 12, respectively, during a discharging phase (and therefore a tipping) towards the left G, during a working phase and during a discharging phase (and therefore a tipping) towards the right D.

Furthermore, to facilitate the emptying, the vehicle 1 comprises removable arms 34 which can be removed and replaced as desired. These arms 34 can be retractable, and for example of telescopic or retractable type in the chassis 2. The arms 34, when they are installed, are used to hold (or to support) a flexible transport bag 35 (of the "big-bag" type). Preferably, two arms 34 are provided, which are positioned in a horizontal direction, perpendicular to the longitudinal axis X, at the same height, by being spread apart from one another along the longitudinal direction X by a distance suitable for the transport bag 35, so that each preferably passes into two straps of the transport bag 35 (provided with four straps).

The arms 34 are positioned on the chassis 2 such that the transport bag 35 that they carry can directly receive the rubble discharged from the collection tank 12, during a tipping of said collection tank 12, as illustrated by the arrows I in FIGS. 5A and 5C.

In one embodiment, the collection tank 12 is configured to have a useful capacity of around 1 $m^3$, corresponding to the capacity of a standard, "big-bag" type transport bag.

The collection tank 12 is further provided with side access doors 36 and 37, left and right, for the discharging in the transport bag 35 of the excavated materials. The vehicle 1 comprises, in addition, a flap 38 on the roof of the collection tank 12 for cleaning.

The vehicle 1 is a compact vehicle having a small gauge, so as to be particularly suitable for working in an urban environment.

In one representative embodiment, the vehicle 1 can have at least some of the following dimensions: a length (along the axis X) in the transfer phase with the raised wheel (FIG. 2), of around 5.5 to 7.5 metres; a length (along the axis X) in the working phase with the lowered wheel (FIG. 1), of around 6.5 to 8 metres; a width (FIG. 5B) less than 1.8 metres; a height H1 (FIG. 5B) in movement or trenching configuration of around 2.7 metres; and a height H2 (FIG. 5A) in discharging configuration of around 3.5 metres.

Furthermore, in one embodiment, the vehicle 1 comprises at least one radar 39 which is mounted on the vehicle 1, towards the front, for example, above the driver station as represented in FIGS. 1 and 2, or in any other place of the vehicle 1 where detection is facilitated. This radar 39 is configured to detect any intrusion in a detection zone defined towards the front and possibly (at least partially) around the vehicle 1, during the working phase, and at least in the path of the vehicle 1. By way of an example, the detection zone is defined over a length of 5 metres at the front of the vehicle 1 and over the width of the gauge of the vehicle 1.

The vehicle 1 also comprises at least one alarm 40 which is mounted on the vehicle 1, preferably towards the rear, for example above the collection tank 12 as represented in FIGS. 1 and 2, or in any other place of the vehicle 1 where it makes it possible to effectively produce a warning. This alarm 40, of sound and/or visual type, is configured to warn the operator O (by sound and/or visual signals) in case of detection by the radar 39 of an intrusion, for example, of a person or an obstacle, in the detection zone.

Consequently, if an intrusion is detected during the working phase, the operator O who is generally located towards the rear of the vehicle 1 is warned of the intrusion by the alarm 40. He can thus implement the measures which are required, and in particular stop the advancing of the vehicle 1 or if a person is responsible for the intrusion, requesting for example the person to move away from the vehicle 1.

In some embodiments, the vehicle 1 also comprises a stop unit (not represented) which is configured to automatically stop at least the advancing of the vehicle 1, if the operator O has not carried out a planned action, at the end of a predetermined duration after an intrusion detection by the radar 39. This action that the operator O must carry out to avoid the activation of the stop unit can be to stop the advancing of the vehicle and/or to actuate a dedicated element, for example a button, which is for example provided on the vehicle or preferably on the control unit 11. This embodiment thus makes it possible to help make the working phase safe.

Thus, the vehicle 1 such as described above, is driven by a single person (or operator O), either using the driver station 12 for a movement during a transfer phase, or using the control unit 11 (or remote-controlled outer driver station) for a movement during a working phase. During the working phase, i.e. in particular during the digging of a trench, this single and same operator O can control, using the portable control unit 11, all the operations and functions necessary for the digging of the trench, namely the digging, the collection of rubble and the advancing of the vehicle.

Consequently, all the work can be carried out by a single operator O, instead of two or more, which in particular makes it possible to reduce the production cost of the site.

In addition, as the control unit 11 is portable and remote (i.e. it is not mechanically connected to the vehicle), the operator O can be moved in the proximity or even around the vehicle 1, which makes it possible for him to have an extended vision, even overall vision, of the site, and therefore to facilitate his work.

The functioning and the use of the vehicle 1 are described below.

If it is located far away from the site, the vehicle 1 is mounted on an industrial carrier, for example a lorry or a towed trailer, and it is brought by this carrier to the site. Thanks to the gauge thereof and the reduced weight thereof, the vehicle 1 can be easily and quickly brought by a carrier to the site.

If necessary, the vehicle 1 can then be driven to the working (or trenching) zone by being moved by the operator O from the driver station 10 in a transfer phase.

When the vehicle 1 is located in the working zone (with or without initial transfer phase), the working phase and in particular the digging can start. These operations are controlled (via remote controls) by the operator using the control unit 11.

During the digging of the trench, the vehicle 1 is driven by a hydrostatic transmission also supplying the different services (actuators, motors, etc.) and making it possible to easily adapt the advancing thereof to the digging of the trench. The trench T is executed with the trenching tool 8 of the digging device 7 which is positioned suitably (as represented in FIG. 1). Owing to the advancing of the vehicle 1 via the hydrostatic transmission thereof and to the rotation of the wheel trencher 22, the cutting members 23 dig the trench T progressively. The rubble produced by the excavation along the cutting face is driven towards the inside of the casing 32 of which the inner space is under low pressure. The rubble exiting the cutting face is thus suctioned in the direction of the suction conduit 28. The suctioned rubble is collected mostly in the collection tank 12. Remaining fine particles can be trapped in filtering systems of the device 9. All the rubble produced is thus suctioned and recovered in the collection tank 12 or in the filters.

When the collection tank 12 is filled, it is emptied in the abovementioned manner, by discharging the rubble into a transport bag 35.

The emptying of the collection tank 12 in "big-bag" type transport bags 35 avoids, in the working phase, having to go and empty the discharging collection tank 12 when it is filled, and thus makes it possible to optimise the production time at the site. The filled transport bags 35 remain on the site and can be recovered later by a dedicated lorry.

Finally, when the trench T is produced, the wheel trencher 22 of the digging device 7 is returned onto the chassis 2 (as represented in FIG. 2), so as to make it possible for the vehicle 1, either moving without difficulty and legally on the road network, in a transfer phase, in particular to be brought back to another working zone on the same site, or to be loaded onto a carrier, for example to be brought back to another site.

The vehicle 1 is configured to be able to be moved in a transfer phase at a maximum speed of 25 km/h, which makes it possible on a defined site to be able to quickly move the vehicle towards trenching zones which can be discontinuous on said site. These trenching zones can be separated from one another by a few hundred metres, in particular.

Furthermore, in a working phase, the vehicle 1 is subjected to a hydrostatic movement at a low speed for trenching works. In the scope of the present disclosure, the following can be provided, as an illustration, for the advancing of the vehicle 1 in the working phase: an advancing working speed, quick, up to 2 km/h as a maximum; and an advancing working speed, slow, from 30 to 180 metres per hour.

The present application may include references to directions, such as "forward," "rearward," "front," "rear," "upward," "downward," "top," "bottom," "right hand," "left hand," "lateral," "medial," "in," "out," "extended," etc. These references, and other similar references in the present application, are only to assist in helping describe and to understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. The terms "about," "approximately," "near," etc., mean plus or minus 5% of the stated value. For the purposes of the present disclosure, the phrase "at least one of A, B, and C," for example, means (A), (B), (C), (A and B), (A and C), (B and C), or (A, B, and C), including all further possible permutations when greater than three elements are listed.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A motor vehicle for digging trenches in the ground, comprising:
- a chassis having a motor unit;
- a controllable digging device mounted on the chassis, the controllable digging device comprising:
  - a trenching tool configured to dig a trench; and
  - a controllable suctioning and collecting device configured to suction and collect rubble produced during the digging of the trench with the trenching tool;
- a driver station for the movement on the ground of the vehicle during a transfer phase;
- a portable and remote control unit configured to enable an operator to remotely control one or more of the digging device, the suctioning, and the collecting device during digging in the course of a working phase and the advancing of the vehicle at least during the working phase.

2. The vehicle according to claim 1, wherein the suctioning and collecting device comprises a tipping collection tank, of which the tipping is controllable, and wherein the control unit is configured to enable the operator to also remotely control the tipping of the collection tank.

3. The vehicle according to claim 2, wherein the collection tank is configured to be tipped laterally towards either of the two sides.

4. The vehicle according to claim 2, further comprising removable support arms of a transport bag, said arms being positioned on the chassis such that the transport bag directly receives the rubble discharged from the collection tank during a tipping of said collection tank.

5. The vehicle according to claim 1, wherein the motor unit comprises at least four guide wheels.

6. The vehicle according to claim 5, wherein the control unit is configured to enable the operator to remotely control the direction of the guide wheels.

7. The vehicle according to claim 5, wherein the guide wheels of the motor unit are configured to enable movement of the vehicle in a crab mode.

8. The vehicle according to claim 1, wherein the motor unit comprises two front wheels capable of being driven and two rear wheels capable of being driven.

9. The vehicle according to claim 8, wherein the motor unit is configured such that the two front wheels are driven during the transfer phase and that the two rear wheels are driven during the working phase.

10. The vehicle according to claim 1, wherein the control unit comprises a portable casing equipped with control members and a radio emission unit comprising an antenna, the emission unit configured to emit by radio-electric waves the command orders generated by the operator by way of the control members.

11. The vehicle according to claim 10, further comprising an embedded auxiliary control unit comprising a radio reception unit configured to receive the command orders emitted via radio-electric waves by the control unit, a central unit to process the command orders received, and connection means to transmit commands to the vehicle according to the command orders received.

12. The vehicle according to claim 1, wherein the suctioning and collecting device is arranged in the central part of the chassis, and wherein the digging device is arranged in the rear part of the chassis.

13. The vehicle according to claim 1, further comprising a radar configured to detect an intrusion in at least one detection zone defined at least partially around the vehicle, and an alarm configured to warn the operator in case of the detection of an intrusion.

14. The vehicle according to claim 13, further comprising a stop unit configured to automatically stop the advancing of the vehicle if the operator has not carried out a planned action at the end of a predetermined duration after an intrusion detection.

* * * * *